US010672584B2

(12) United States Patent
Teramoto et al.

(10) Patent No.: US 10,672,584 B2
(45) Date of Patent: Jun. 2, 2020

(54) X-RAY GENERATOR

(71) Applicant: USHIO DENKI KABUSHIKI KAISHA, Tokyo (JP)

(72) Inventors: Yusuke Teramoto, Tokyo (JP); Takahiro Shirai, Tokyo (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 16 days.

(21) Appl. No.: 16/309,073

(22) PCT Filed: May 30, 2017

(86) PCT No.: PCT/JP2017/020024

§ 371 (c)(1),
(2) Date: Dec. 11, 2018

(87) PCT Pub. No.: WO2017/217228

PCT Pub. Date: Dec. 21, 2017

(65) Prior Publication Data

US 2019/0259557 A1 Aug. 22, 2019

(30) Foreign Application Priority Data

Jun. 15, 2016 (JP) ..... 2016-119083

(51) Int. Cl.
*H01J 35/10* (2006.01)
*H05G 2/00* (2006.01)
(Continued)

(52) U.S. Cl.
CPC ..... *H01J 35/101* (2013.01); *H01J 35/10* (2013.01); *H05G 2/00* (2013.01); *H01J 35/00* (2013.01);
(Continued)

(58) Field of Classification Search
CPC ..... H05G 2/006; H05G 2/005
(Continued)

(56) References Cited

U.S. PATENT DOCUMENTS 4,866,517 A * 9/1989 Mochizuki ..... B82Y 10/00 378/119
5,995,584 A * 11/1999 Bhatt ..... H01J 35/101 378/125
(Continued)

FOREIGN PATENT DOCUMENTS

DE 10106740 A1 8/2002
EP 2656369 B1 7/2016
(Continued)

OTHER PUBLICATIONS

An Office Action mailed by the Japanese Patent Office dated Nov. 19, 2019, which corresponds to Japanese Patent Application No. 2016-119083 and is related to U.S. Appl. No. 16/309,073.
(Continued)

*Primary Examiner* — Yara B Green
(74) *Attorney, Agent, or Firm* — Studebaker & Brackett PC

(57) ABSTRACT

A X-ray generating device includes a chamber, a rotating body in the chamber, a starting material storage vessel for storing a target starting material in liquid form, and a starting material supply mechanism for applying the target starting material onto a surface of the rotating body. The X-ray generating device also includes an energy beam inlet window disposed at an opening of the chamber and configured to transmit an energy beam, which will be directed onto the target starting material on the surface of the rotating body and introduce the energy beam from the exterior of the chamber to the interior of the chamber, and an X-ray outlet window disposed at the opening of the chamber and configured to transmit the X-rays, which are generated upon
(Continued)

irradiating the target starting material with the energy beam, and allow the X-rays to proceed to the exterior of the chamber.

20 Claims, 4 Drawing Sheets

(51) Int. Cl.
*H01J 35/14* (2006.01)
*H01J 35/00* (2006.01)

(52) U.S. Cl.
CPC ..... *H01J 35/14* (2013.01); *H01J 2235/082* (2013.01)

(58) Field of Classification Search
USPC ..... 378/144
See application file for complete search history.

(56) References Cited

U.S. PATENT DOCUMENTS

| | | | | |
|---|---|---|---|---|
| 6,430,261 | B1 * | 8/2002 | Bathe | H01J 35/103 378/132 |
| 6,925,151 | B2 | 8/2005 | Harding et al. | |
| 7,368,094 | B2 * | 5/2008 | Cho | B01D 53/32 204/176 |
| 7,471,769 | B2 * | 12/2008 | Harding | H01J 35/08 378/119 |
| 7,746,982 | B2 * | 6/2010 | Yoshii | H01J 35/101 378/132 |
| 8,102,969 | B2 * | 1/2012 | Bittl | H01J 35/103 378/130 |
| 9,380,690 | B2 | 6/2016 | Hemberg et al. | |
| 9,480,136 | B2 * | 10/2016 | Teramoto | H05G 2/006 |
| 9,947,502 | B2 | 4/2018 | Hemberg et al. | |
| 2003/0142789 | A1 * | 7/2003 | Harding | H01J 35/08 378/119 |
| 2005/0089144 | A1 * | 4/2005 | Fukushima | H01J 35/101 378/144 |

FOREIGN PATENT DOCUMENTS

| | | | |
|---|---|---|---|
| EP | 3089192 | B1 | 5/2018 |
| JP | 2004-519083 | A | 6/2004 |
| JP | 5694558 | B2 | 4/2015 |

OTHER PUBLICATIONS

International Search Report issued in PCT/JP2017/020024; dated Aug. 22, 2017.

* cited by examiner

X-RAY GENERATOR

TECHNICAL FIELD

The present invention relates to an X-ray generating device that generates X-rays.

BACKGROUND ART

Conventionally, X-rays are used in a medical device, an industrial device, and a laboratory device. In the medical field, the X-rays are used for chest radiography, dental radiography and CT (Computer Tomogram). In the industrial field, the X-rays are used for nondestructive inspection to observe the interior of a substance such as a structure, a building and a welding part, and for nondestructive tomography inspection. In the research field, the X-rays are used for X-ray diffraction to analyze the crystal structure of a substance, and for X-ray spectroscopy (X-ray fluorescence analysis) to analyze the structural elements of a substance.

The X-rays may be generated with an X-ray tube. The X-ray tube has a pair of electrodes (anode and cathode) therein. An electric current is caused to flow to a cathode filament to heat the cathode filament, and a high voltage is applied across the anode and the cathode. Then, the minus thermo-electrons generated from the filament impinge upon a target on the surface of the anode at a high speed, and the X-rays are generated from the target.

Patent Literature Document 1 (Japanese Patent No. 5694558) discloses that a target on the anode side of the X-ray tube is a liquid metal jet, and the target is irradiated with an electron beam to obtain X-rays at a high luminance.

LISTING OF REFERENCES

Patent Literature Documents

Patent Literature Document 1: Japanese Patent No. 5694558

SUMMARY OF THE INVENTION

Problems to be Solved by the Invention

However, the teaching of Patent Literature Document 1 (Japanese Patent No. 5694558) requires a complicated structure such as a structure to obtain the liquid metal jet, and alignment for irradiating the jet with the electron beam.

In view of this, an object of the present invention is to provide an X-ray generating device that has a relatively simple structure but is still able to obtain X-rays at a high luminance.

Solution to the Problems

In order to achieve the above-mentioned object, an X-ray generating device according to one aspect of the present invention includes a chamber, a disc-like rotating body arranged in the chamber, a first raw material (first starting material) reserving vessel configured to reserve a liquid target raw material for X-ray generation, a raw material supply mechanism configured to cause the rotating body to rotate while part of the rotating body is being immersed in the target raw material, which is reserved in the first raw material reserving vessel, thereby applying the target raw material onto at least part of a surface of the rotating body, an energy beam inlet window disposed at (in) an opening of the chamber and configured to transmit an energy beam, which is directed to the target raw material on the surface of the rotating body, and allow the energy beam to enter an interior of the chamber from an exterior of the chamber, and an X-ray outlet window disposed at (in) the opening of the chamber and configured to transmit X rays, which are generated upon irradiating the target raw material with the energy beam, and allow the X rays to proceed out of the chamber.

When the rotating body is caused to rotate in the chamber as described above, the target raw material for the X-ray generation is applied onto the surface of the rotating body, and the area where the target raw material is applied is then irradiated with the energy beam to generate X-rays. Thus, it is possible to obtain X-rays at a high luminance by the X-ray generating device having a relatively simple structure. Because the inlet window for allowing the energy beam to enter the chamber and the outlet window for allowing the X-rays to exit the chamber are provided at (in) the opening of the chamber, it is possible to achieve the X-ray generation in a stable manner while maintaining an appropriate processing atmosphere in the chamber.

The target raw material used in the X-ray generating device may be liquid at room temperature. When the target raw material that is liquid at room temperature is used, a heating mechanism or device for maintaining the target raw material in a liquid condition is not necessary. Also, because the temperature of the target raw material is not high, the first raw material reserving vessel that reserves the target raw material does not have to have a heat resistance, and the respective parts and members that prevent the target raw material from flying and spreading do not have to have a heat resistance. Accordingly, the X-ray generating device can have an even simpler structure.

The X-ray generating device may further include a first catching member disposed between the rotating body and the X-ray outlet window and configured to transmit the X-rays and catch the target raw material. In this configuration, the first catching member can catch the target raw material, which flies from the rotating body, before the target raw material reaches the X-ray outlet window. Therefore, it is possible to prevent the target raw material from adhering onto the X-ray outlet window.

The first catching member of the X-ray generating device may be a plate-like rotating member. In this configuration, it is possible to easily remove the liquid target raw material, which has adhered onto the surface of the first catching member, from the surface of the first catching member by a centrifugal force generated upon rotations of the first catching member.

The X-ray generating device may further include a second catching member disposed between the rotating body and the energy beam inlet window and configured to transmit the energy beam and catch the target raw material. In this configuration, the second catching member is able to catch the target raw material, which flies from the rotating body, before the target raw material arrives at the energy beam inlet window. Thus, it is possible to prevent the target raw material from adhering onto the energy beam inlet window.

The second catching member of the X-ray generating device may be a plate-like rotating member. In this configuration, it is possible to easily remove the liquid target raw material, which has adhered onto the surface of the second catching member, from the surface of the second catching member by a centrifugal force generated upon rotations of the second catching member.

The X-ray generating device may further include a film thickness adjusting unit configured to adjust a film thickness of the target raw material on the surface of the rotating body to a predetermined film thickness, and the film thickness adjusting unit may have a film thickness adjusting member that faces the surface of the rotating body with a predetermined gap, which corresponds to the predetermined film thickness. In this configuration, it is possible to cause the liquid target raw material applied on the surface of the rotating body to have an appropriate film thickness.

The film thickness adjusting member may be located at a position that can adjust the film thickness of the target raw material in an area of the rotating body which is irradiated with the energy beam. In this configuration, it is possible to cause the liquid target raw material applied on the surface of the rotating body to have a film thickness that is suitable for the X-ray generation that takes place upon the energy beam irradiation.

The first raw material reserving vessel of the X-ray generating device may be a jacket-like structure that encloses the rotating body, and may have an opening at a position corresponding to the area of the rotating body which is irradiated with the energy beam such that the energy beam passes through the opening. When the first raw material reserving vessel has such jacket-like structure, it is possible to reduce the possibility that the liquid target raw material flies and spreads in the chamber upon rotations of the rotating body.

The first raw material reserving vessel of the X-ray generating device may be a container that has an opening in its upper portion. This allows the first raw material reserving vessel to have a simpler structure. In this configuration, the liquid target raw material may fly and spread in the chamber upon rotations of the rotating body. However, if the target raw material is not corrosive, it is not necessary to carry out a treatment to impart the corrosion-resistance on the inner wall of the chamber.

The X-ray generating device may further include a discharge exit formed at a bottom of the chamber and configured to discharge the target raw material, which has accumulated at the bottom of the chamber, out of the chamber. In this configuration, it is possible to appropriately take the target raw material out of the X-ray generating device even if the liquid target raw material flies and spreads in the chamber upon rotations of the rotating body. The first raw material reserving vessel of the X-ray generating device may have a raw material recovering hole formed in a side wall of the first raw material reserving vessel at a position above the bottom of the chamber and configured to recover (move) the target raw material, which has accumulated at the bottom of the chamber, into the first raw material reserving vessel. In this configuration, it is possible to cause the liquid target raw material, which has flied and spread in the chamber upon rotations of the rotating body, to return to the first raw material reserving vessel.

The chamber of the X-ray generating device may have a first space, which includes a space for arranging the energy beam inlet window and the X-ray outlet window, and a second space, which includes a space for arranging the rotating body, the second space may be spatially connected to the first space, and an atmosphere in the second space may be set to a lower pressure than an atmosphere in the first space.

In this configuration, even if the target raw material flies and spreads from the surface of the rotating body in the second space upon rotations of the rotating body, it is possible to eliminate or reduce the possibility that the flying target raw material enters the first space. Thus, it is possible to eliminate or reduce the possibility that the target raw material, which flies and spreads from the rotating body, adheres onto the energy beam inlet window and the X-ray outlet window.

The X-ray generating device may further include a cooling mechanism or unit configured to cool the target raw material in the first raw material reserving vessel. In this configuration, it is possible to eliminate or reduce the possibility that the temperature of the target raw material in the first raw material reserving vessel changes due to the heating caused by the energy beam irradiation. As a result, the target raw material can adhere onto the surface of the rotating body in a stable manner, and the X-ray generation can take place in a stable manner.

The X-ray generating device may further include a second raw material reserving vessel disposed outside the chamber and configured to reserve the target raw material, and a circulating mechanism or unit configured to circulate the target raw material between the first raw material reserving vessel and the second raw material reserving vessel.

In this configuration, it is possible to increase a heat capacity of the target raw material recirculated by the circulating mechanism, and suppress the temperature change of the target raw material in the first raw material reserving vessel. As a result, the target raw material can adhere onto the surface of the rotating body in a stable manner, and the X-ray generation can take place in a stable manner. Also, it is possible to supplement the target raw material into the first raw material reserving vessel from the second raw material reserving vessel when the target raw material in the first raw material reserving vessel is consumed upon generation of the X-rays. Thus, the X-ray generation can take place in a stable manner for a long time.

The target raw material used in the X-ray generating device may be gallium or a gallium alloy. This makes it possible to properly generate the X-rays.

Advantageous Effects of the Invention

The present invention can provide X-rays at a high luminance with a relatively simple structure.

These and other objects, aspects and advantages of the present invention will be understood by a skilled person from the following detailed description of the invention by referring to the accompanying drawings and claims.

DESCRIPTION OF EMBODIMENTS

Embodiments of the present invention will now be described with reference to the accompanying drawings.

First Embodiment

Figure 1:
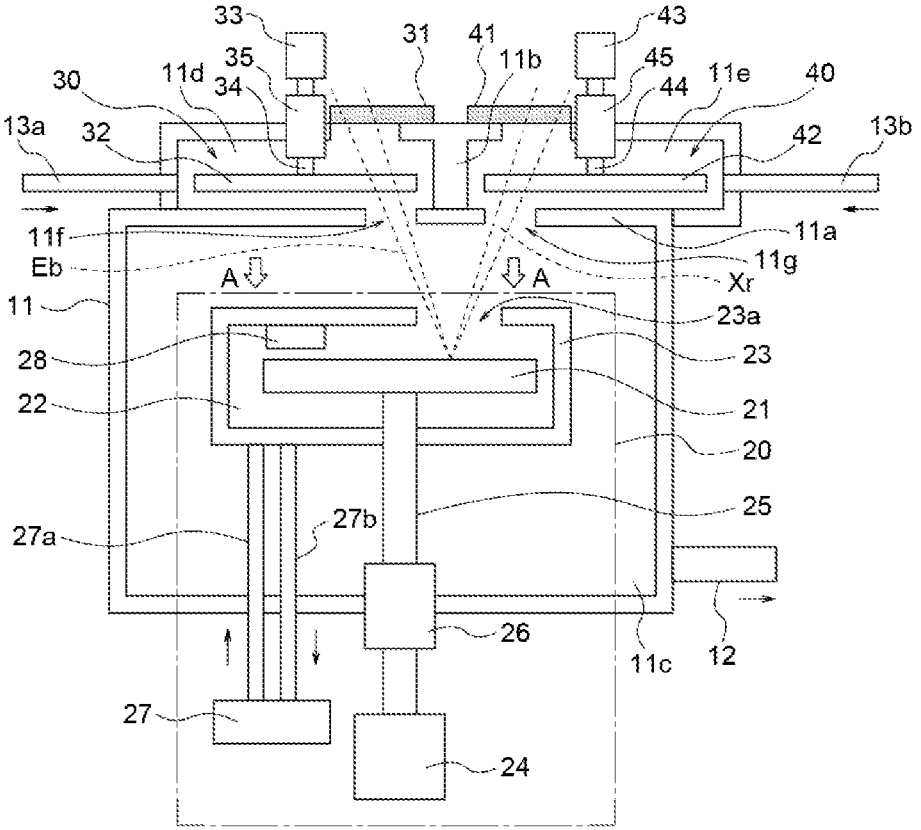
FIG. 1 is a schematic view of a structure of an X-ray generating device according to a first embodiment of the present invention.

FIG. 1 shows a schematic structure of an X-ray generating device 100 according to a first embodiment. FIG. 1 is a view when the X-ray generating device 100 is looked at from the above.

The X-ray generating device 100 is a device to emit hard X-rays to soft X-rays at a wavelength of, for example, 10 nm or shorter.

As shown in FIG. 1, the X-ray generating device 100 has a chamber 11. The chamber 11 is generally divided into two spaces by a partition wall 11*a*. One of the two spaces is a first space that is further divided into two sub-spaces (i.e., an energy beam incoming space 11*d* and an X-ray outgoing space 11*e*) by another partition wall 11*b*. The other of the two spaces is a second space 11*c* that is spatially connected to the first space by openings 11*f* and 11*g* formed in the partition wall 11*a*.

The air in the second space 11*c* is discharged to the outside through an air exit 12 by a vacuum pump (not shown) or a similar device. A gas is introduced into the first space (the energy beam incoming space 11*d* and the X-ray outgoing space 11*e*) from a gas supply device (not shown) via gas inlets 13*a* and 13*b*. The gas used here is a gas that has a high transmissivity to the energy beam Eb and the X-ray (Xr). For example, the gas may be a rare gas such as an argon gas (Ar), a helium gas (He), or the like. It should be noted that the gas introduced to the energy beam incoming space 11*d* and the gas introduced to the X-ray outgoing space 11*e* may be the same or may be different from each other.

As described above, the atmosphere in the second space 11*c* is maintained at a lower pressure than the first spaces 11*d* and 11*e*. It should be noted that the interior of the second space 11*c* is not necessarily a vacuum atmosphere as long as the pressure of the second space 11*c* is lower than the first spaces 11*d* and 11*e*. Also, an inert gas may be introduced into the second space 11*c*.

The X-ray generating device 100 also includes a raw material feeding unit 20, an energy beam inlet part 30, and an X-ray outlet part 40. The raw material feeding unit 20 is disposed in (or associated with) the second space 11*c*. The energy beam inlet part 30 is disposed in the energy beam incoming space 11*d*. The X-ray outlet part 40 is disposed in the X-ray outgoing space 11*e*. The details of the raw material feeding unit, the energy beam inlet part, and the X-ray outlet part will be described below.

The Raw Material Feeding Unit 20

The raw material feeding unit 20 has a disc-shaped rotating body 21. The rotating body 21 may be made from a metal having a high melting point such as tungsten, molybdenum, or tantalum. Part of the rotating body 21 is immersed in a target raw material (simply referred to as a "raw material" or "starting material" hereinafter) 22, which is immersed in the raw material reserving vessel 23 (i.e., first raw material reserving vessel) and used in generating the X-rays. In this embodiment, the raw material 22 is a metal that is liquid at room temperature. For example, the raw material 22 may be gallium or a gallium alloy such as Galinstan (registered trademark), which is a eutectic alloy of gallium, indium and tin.

A rotating shaft 25 of a motor 24 is attached to an approximate center of the rotating body 21. Thus, the rotating body 21 rotates as the motor 24 causes the rotating shaft 25 to rotate. The motor 24 is driven and controlled by a controller (not shown). The rotating shaft 25 extends in the chamber 11 via a mechanical seal 26. The mechanical seal 26 allows the motor 25 to rotate while maintaining the atmosphere in the chamber 11 (maintaining the reduced pressure in the second space 11*c*).

Figure 2:
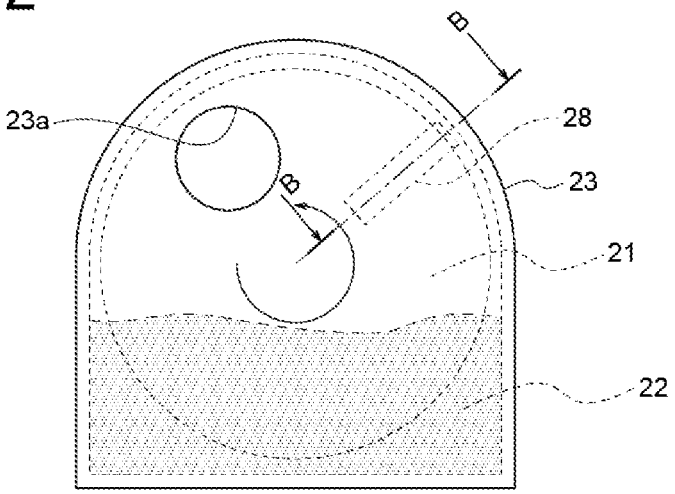
FIG. 2 is a drawing when viewed in the direction of the arrow A in FIG. 1.

The raw material reserving vessel 23 encloses the most part (large portion) of the rotating body 21 with a gap such that the raw material reserving vessel 23 does not interfere with the rotating movement of the rotating body 21. Specifically, as shown in FIG. 2 that illustrates the rotating body 21 and the raw material reserving vessel 23 when viewed in the direction of the arrows A in FIG. 1, the raw material reserving vessel 23 is a jacket-like structure that has an opening 23*a*. The opening 23*a* is formed at a position that correspond to that area of the rotating body 21 which is irradiated with the energy beam (e.g., electron beam) Eb The raw material reserving vessel 23, which is the jacket-like structure, has a raw material reserving portion to reserve the liquid raw material 22 in a lower portion of the raw material reserving vessel. The raw material 22 may be loaded or supplemented into the raw material reserving vessel 23 by a raw material circulating device 27 (will be described).

As the rotating body 21 rotates about the rotating shaft 25, with part of the rotating body 21 being immersed in the raw material 22 reserved in the raw material reserving vessel 23, the raw material 22 is lifted up from the raw material reserving portion of the raw material reserving vessel 23 along the surface of the rotating body 21 due to the wettability with the surface of the rotating body 21, and the raw material is transferred. In other words, the motor 24 and the rotating shaft 25 serve as a raw material feeding mechanism to apply the raw material 22 onto at least part of the surface of the rotating body 21.

As the rotating body 21 rotates, the centrifugal force produced upon the rotation of the rotating body causes the raw material 22 on the surface of the rotating body 21 to fly and spread. As described above, however, the rotating body 21 is surrounded (enclosed) by the raw material reserving vessel 23, i.e., the jacket-like structure. Therefore, the raw material 22 flying and spreading (scattering) from the rotating body 21 adheres onto the inner wall of the raw material reserving vessel 23, except for the opening 23*a* of the raw material reserving vessel 23. Then, the raw material 23, which is present on the inner wall, moves to the raw material reserving portion, i.e., the lower portion of the raw material reserving vessel 23. Accordingly, the raw material 22 hardly flies and spreads into the inner space of the chamber 11, which is outside the raw material reserving vessel 23.

A film thickness adjusting member (skimmer) 28 is disposed in the raw material reserving vessel 23 to adjust the film thickness of the raw material 22 on the surface of the rotating body 21 to a desired or predetermined film thickness.

Figure 3:
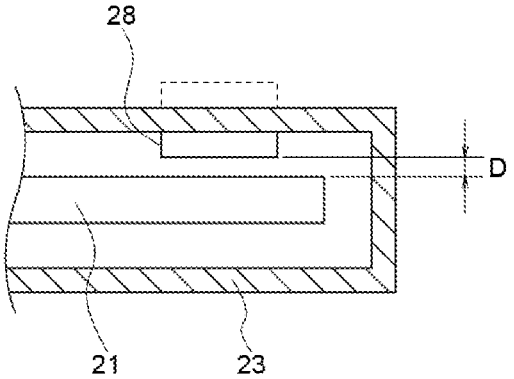
FIG. 3 is a cross-sectional view taken along the B-B line in FIG. 2.

FIG. 3 is a cross-sectional view taken along the line B-B in FIG. 2. As illustrated in FIG. 3, the skimmer 28 is attached to the inner wall of the raw material reserving vessel 23. The skimmer 28 is a block-like structure that provides (leaves) a predetermined gap D between the disc-like surface of the rotating body 21 and the skimmer. The skimmer 28 serves as a scraper to scrape part of the raw material 22 applied onto the disc-like surface of the rotating body 21.

The gap D corresponds to the predetermined film thickness of the raw material 22 in that area of the surface of the rotating body 21 which is irradiated with the energy beam. The skimmer 28 is located at a position that enables the adjustment of the film thickness of the raw material 22 in the area of the surface of the rotating body 21, which is irradiated with the energy beam, to the above-mentioned predetermined film thickness. With such structure, the film thickness of the liquid raw material 22 applied onto the rotating body 21 in the raw material reserving portion is adjusted to the predetermined film thickness as the raw material passes through the skimmer 28 upon rotation of the rotating body 21.

It should be noted that the thickness of the skimmer 28 itself may be greater than the thickness of the raw material reserving vessel 23. In this configuration, the skimmer may protrude from the jacket-like structure, as indicated by the broken line in FIG. 3.

The raw material 22 on the rotating body 21, whose film thickness has been adjusted by the skimmer 28, is transferred to an area that corresponds to the opening 23*a* of the raw material reserving vessel 23 (area irradiated with the energy beam Eb) upon rotation of the rotating body 21. Thus, the rotating direction of the rotating body 21 is the direction that causes the raw material 22 on the rotating body 21 to move to the area irradiated with the energy beam Eb after the raw material 22 passes through the skimmer 28, as indicated by the arrow in FIG. 2 (i.e., the counterclockwise direction in FIG. 2). The raw material 22 on the rotating body 21 is then irradiated with the energy beam Eb in the area that corresponds to the opening 23*a* of the raw material reserving vessel 23.

Now, the structure of the raw material circulating device 27 will be described.

Figure 4:
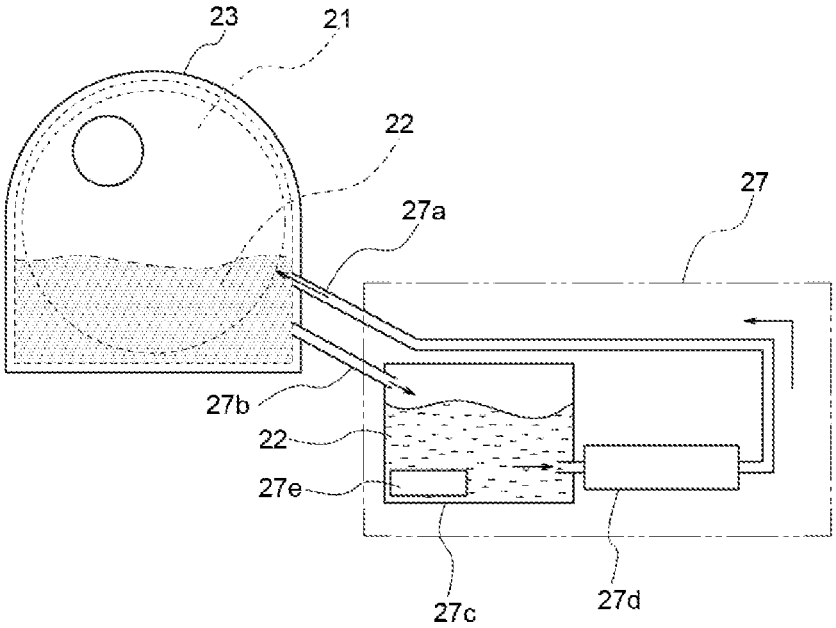
FIG. 4 shows an exemplary structure of a raw material circulating device.

The raw material circulating device 27 supplements the raw material 22 into the raw material reserving vessel 23 at appropriate timing when the raw material 22 is consumed upon generation of the X-rays. Also, the raw material circulating device 27 serves as a temperature adjusting mechanism (cooling mechanism) to adjust the temperature of the raw material 22. An exemplary structure of the raw material circulating device 27 is illustrated in FIG. 4.

The raw material circulating device 27 includes a raw material flow-in conduit 27*a* and a raw material flow-out conduit 27*b* to circulate the raw material 22 between the raw material reserving vessel 23 and the raw material circulating device. The raw material flow-in conduit 27*a* and the raw material flow-out conduit 27*b* are connected to the raw material reserving portion of the raw material reserving vessel 23. The raw material circulating device 27 also includes a second raw material reserving vessel 27*c* to reserve the raw material 22, and a raw material driving unit 27*d* to circulate the raw material 22. In this embodiment, the raw material driving unit 27*d* may be, for example, an electromagnetic pump that uses a magnetic force to transfer the liquid metal. The second raw material reserving vessel 27*c* and the raw material driving unit 27*d* are disposed outside the chamber 11.

That part of the raw material 22 applied on the surface of the rotating body 21, which is irradiated with the energy beam Eb, is consumed. In order to carry out the X-ray generation in a stable manner for a long time, therefore, it is necessary to reserve a large amount of raw material 22 in the raw material reserving vessel 23. However, because a certain balance is needed between the size of the chamber 11 of the X-ray generating device 100 and the raw material reserving vessel, there is a limitation on the size of the raw material reserving vessel 23 which should be housed in the chamber 11. Accordingly, it is difficult to reserve a large amount of raw material 22 in the raw material reserving vessel 23.

To address this difficulty, the second raw material reserving vessel 27*c* that can reserve a large amount of raw material 22 is disposed outside the chamber 11. This enables the supplementing of the raw material 22 to the raw material reserving portion of the raw material reserving vessel 23 through the raw material flow-in conduit 27*a*. Thus, an amount of raw material 22 in the raw material reserving portion of the raw material reserving vessel 23 is maintained at a constant value for a long time. As a result, it is possible to carry out the X-ray generation in a stable manner for a long time.

As such, the raw material circulating device 27 causes the raw material 22 to circulate between the raw material reserving portion of the raw material reserving vessel 23 and the second raw material reserving vessel 27*c* in order to keep an amount of raw material 22 in the raw material reserving portion of the raw material reserving vessel 23 at a constant value.

The X-rays are generated from the target as the raw material 22 applied onto the surface of the rotating body 21 is irradiated with the energy beam Eb. At the same time, the rotating body 21 itself is heated. The heat exchange takes place between the raw material 22 in the raw material reserving vessel 23 and the heated rotating body as the rotating body 21 22 moves through the raw material reserving portion of the raw material reserving vessel 23 where the raw material 22 is reserved. Thus, the temperature of the raw material 22 in the raw material reserving vessel 23 would gradually change if no measures are taken. If the viscosity of the raw material 22 changes with the temperature, the wettability of the rotating body 21 relative to the raw material 22 changes with the temperature of the raw material 22. This alters the adhering condition of the raw material 22 on the rotating body 21. As a result, the output of the X-rays would change.

The raw material circulating device 27 includes the second raw material reserving vessel 27*c* outside the chamber 11. The second raw material reserving vessel 27*c* has a relatively large size. Thus, even if the raw material 22, which has changed the temperature thereof in the raw material reserving portion of the raw material reserving vessel 23, flows into the second raw material reserving vessel 27*c* through the raw material flow-out conduit 27*b*, the temperature of the raw material 22 in the second raw material reserving vessel 27*c* does not change very much, i.e., the temperature of the raw material is substantially maintained at the constant value. Then, the raw material 22 whose temperature is maintained at the substantially constant value is forced to flow into the raw material reserving vessel 23 through the raw material flow-in conduit 27*a*. The raw material 22 is circulated by the raw material circulating device 27 in the above-described manner Thus, the temperature of the raw material 22 in the raw material reserving vessel 23 is kept at a substantially constant value. Accordingly, the adhering condition of the raw material 22 on the rotating body 21 becomes stable, and the output (generation) of the X-rays also becomes stable.

It should be noted that the temperature of the raw material 22 in the second raw material reserving vessel (tank) 27*c* may be adjusted and controlled by a temperature adjusting unit 27*e* disposed in the second raw material reserving vessel 27*c*. Because the second raw material reserving vessel 27*c* is located outside the chamber 11, the second raw material reserving vessel 27*c* can use the temperature adjusting unit 27*e* that can have a large capacity, which is not limited by the size of the chamber 11. This enables the temperature adjustment of the raw material 22 in a short time, and it is possible to quickly adjust the temperature of the raw material 22 to a desired value in a reliable manner.

As described above, the raw material circulating device 27 that has the temperature adjusting unit 27*e* can supply the raw material 22 to the raw material reserving portion of the raw material reserving vessel 23 while maintaining the temperature of the liquid metal (raw material 22, which is liquid at room temperature) at the constant value. In other words, if the raw material circulating device 27 is used, it is possible to feed the raw material 22, which is liquid at a temperature equal to or lower than the room temperature, to the raw material reserving portion of the raw material reserving vessel 23 while maintaining the temperature of the liquid metal (raw material 22) at a value lower than the room temperature. The raw material circulating device 27 serves as a cooling mechanism to cool the raw material 22 in order to keep the raw material 22 at the predetermined temperature.

It should be noted that the cooling mechanism is not limited to the mechanism that utilizes the raw material circulating device 27 shown in FIG. 4. For example, a cooling mechanism that includes a chiller and a pipe (or pipes) to circulate a cooling medium and cool the raw material 22 with the cooling medium may be disposed in the raw material reserving vessel 23. If this configuration is employed, it is not necessary to circulate the raw material 22 between the raw material reserving vessel 23 and an external reserving tank. Thus, the cooling mechanism can have a simpler structure.

It should also be noted that if the temperature change of the raw material 22 in the raw material reserving vessel 23 can be neglectable, the cooling mechanism may not be necessary.

The Energy Beam Inlet Part 30

Referring back to FIG. 1, the structure of the energy beam inlet part 30 will be described.

The energy beam Eb is, for example, an electron beam or a laser beam, and may be emitted from an energy beam emitting device (not shown) disposed outside the chamber 11. As shown in FIG. 1, the energy beam Eb enters the chamber 11 through an energy beam inlet window 31 disposed at the opening of the chamber 11. After entering the chamber 11, the energy beam Eb is directed to the raw material 22 applied on the disc-shaped surface of the rotating body 21 through the opening 23*a* of the raw material reserving vessel 23. As a result, the X-rays are generated.

When the energy beam Eb is the electron beam, the energy beam inlet window 31 may be, for example, a film made from a metal such as titanium or aluminum. When the energy beam Eb is the laser beam, the energy beam inlet window 31 may be made from, for example, a glass material. It should be noted that the energy beam inlet window 31 may be an arbitrary film or may be made from an arbitrary material as long as the energy beam inlet window is made from a material that can transmit the energy beam Eb and has a thickness that can withstand a pressure difference between the outside and the inside of the chamber 11.

It should also be noted that the energy beam inlet part 30 may have a catching mechanism to catch the raw material 22 (including debris). The catching mechanism may be disposed between the rotating body 21 and the energy beam inlet window 31, and more specifically between the opening 23*a* of the raw material reserving vessel 23 and the energy beam inlet window 31. In this embodiment, the catching mechanism includes a rotary window 32 that transmits the energy beam Eb and catches the raw material 22. The rotary window is a plate-like rotating member. The rotary window 32 corresponds to a first catching member. The shape of the rotary window 32 is, for example, a disc shape.

The rotating shaft 34 of the motor 33 is attached to an approximate center of the rotary window 32. Thus, the rotary window 32 rotates as the motor 33 causes the rotating shaft 34 to rotate. The actuation of the motor 33 is controlled by a controller (not shown). The rotating shaft 34 extends into the chamber 11 via a mechanical seal 35. The mechanical seal 35 allows the rotary window 32 to rotate while maintaining the atmosphere in the chamber 11 (maintaining the gas atmosphere of the energy beam incoming space 11*d*).

Part of the raw material 22 adhering on the rotating body 21 flies (leaves) and spreads from the rotating body 21 due to the centrifugal force generated upon the rotation of the rotating body 21. In this embodiment, as described above, the raw material reserving vessel 23 is the jacket-like structure, and therefore most of the raw material 22 that has left and spread from the rotating body 21 stays inside the raw material reserving vessel 23. Nevertheless, some of the raw material 22 flies out of the raw material reserving vessel (within the chamber 11) from the opening 23*a*.

If the rotary window 32 is not provided, the flying-out raw material 22 may adhere onto the energy beam inlet window 31 under certain conditions. When the energy beam Eb is the laser beam, the raw material 22 present on the energy beam inlet window 31 may reduce (weaken) the intensity of the laser beam and the intensity of the X-ray.

The rotary window 32 catches the flying-out raw material 22 without allowing the raw material 22 to reach the energy beam inlet window 31. Because the raw material 22 is the liquid metal, which is liquid at, for example, the room temperature, the raw material 22 adhering on the rotary window 32 leaves the rotary window 32 due to the centrifugal force generated upon the rotation of the rotary window 32. Then, the raw material 22 impinges upon the inner wall of the chamber 11, and ultimately moves to the bottom to the chamber 11.

In this manner, the rotary window 32 can prevent the raw material 22, which exits from the raw material reserving vessel 23 through the opening 23*a* of the raw material reserving vessel 23, from reaching the energy beam inlet window 31. Also, because the rotary window 32 is configured to be rotatable, it is easy to remove the raw material 22 from the rotary window 32 when the raw material is caught by the rotary window. It should be noted that how to remove the raw material 22 from the rotary window 32 is not limited to using the centrifugal force of the rotary window 32. It should also be noted that if the raw material 22 is not corrosive, the raw material 22 that flies from the rotating body 21 and adheres on the inner wall of the chamber 11 does not exert any adverse influence, and therefore it is not necessary to carry out a treatment to impart the corrosion-resistance on the inner wall of the chamber 11.

The X-Ray Outlet Part 40

Now, the structure of the X-ray outlet part 40 will be described.

As described above, the X-rays are emitted from the target as the raw material 22 present on the surface of the rotating body 21 is irradiated with the energy beam Eb. As shown in FIG. 1, the emitted X-rays exit from the chamber 11 through the X-ray outlet window 41 disposed at the opening of the chamber 11.

The X-ray outlet window 41 is made from a material that transmits the X-rays. For example, the X-ray outlet window 41 may be a thin film that is made from beryllium, which has a very high transmissivity to the X-ray. It should be noted, however, that the X-ray outlet window 41 may be made from an arbitrary material with an arbitrary thickness as long as the material transmits the X-rays and the thickness withstands the pressure difference between the outside and the inside of the chamber 11.

Similar to the energy beam inlet part 30, the X-ray outlet part 40 may have a catching mechanism for catching the raw material 22 (including debris). Specifically, the catching mechanism of the X-ray outlet part 40 includes a rotary window 42 to transmit the X-rays and catch the raw material 22, a motor 43, a rotating shaft 44, and a mechanical seal 45. The rotary window 42 corresponds to a second catching member.

If the rotary window 42 is not provided, the raw material 22 flying from the rotating body 21 adheres onto the X-ray outlet window 41 under certain conditions, as in the case of the energy beam inlet window 31. The rotary window 42 can prevent the raw material 22, which exits and flies from the raw material reserving vessel 23 through the opening 23*a* of the raw material reserving vessel 23, from reaching the X-ray outlet window 41.

As described above, the X-ray generating device 100 of this embodiment causes the rotating body 21 to rotate while part of the rotating body 21 being immersed in the raw material 22 stored in the raw material storage tank 23, and applies the raw material 22 on at least part of the surface of the rotating body 21. The X-ray generating device 100 irradiates the raw material 22 applied on the surface of the rotating body 21 with the energy beam to generate the X-rays. Thus, the X-ray generating device has a relatively simple structure but is still able to obtain the X-rays at a high luminance.

In this embodiment, the raw material or the starting material 22 is a metal that is liquid at room temperature. Therefore, a heating mechanism or device is not necessary to convert the X-ray-generation target raw material to a liquid. In addition, because the temperature of the target raw material is not high, the raw material reserving vessel 23 that stores the target raw material does not have to have a heat resistance, and the respective parts and members that contact the target raw material do not have to have a heat resistance. Accordingly, the X-ray generating device can have an even simpler structure.

Moreover, the energy beam inlet window 31 that guides the energy beam Eb into the chamber 11 and the X-ray outlet window 41 that guides the X-ray out of the chamber 11 are provided, and the catching members (rotary windows 32 and 42) that catch the raw material 22 are disposed between the rotating member 21 and the respective windows. Therefore, it is possible to prevent the raw material 22 from adhering onto the energy beam inlet window 31 and the X-ray outlet window 41, and obtain a stable X-ray output.

The X-ray generating device 100 of this embodiment reduces the pressure of the atmosphere in the second space 11*c* as compared to the first space (the energy beam incoming space 11*d* and the X-ray outgoing space 11*e*). This makes it difficult for the raw material 22, which flies out from the opening 23*a* of the raw material reserving vessel 23 located in the second space 11*c*, to enter the first space. As a result, it is possible to eliminate or reduce the possibility that the raw material 22 reaches the energy beam inlet window 32 and the X-ray outlet window 42.

As described above, the X-ray generating device 100 has a relatively simple structure but is still able to eliminate or reduce the possibility that the raw material 22, which leaves and spreads from the rotating body 21, adheres onto the energy beam inlet window 32 and the X-ray outlet window 42. In addition, because each of the catching members of the X-ray generating device 100 is the plate-like (e.g., disc-like) rotating member, the X-ray generating device can employ the simple structure to remove the raw material 22 from the respective catching members.

Second Embodiment

A second embodiment of the present invention will now be described.

The second embodiment is different from the first embodiment in that the raw material reserving vessel 23, which is the first raw material reserving vessel, has a top-covered (jacket-like) structure in the first embodiment whereas the first raw material reserving vessel is an open-top container in the second embodiment.

Figure 5:
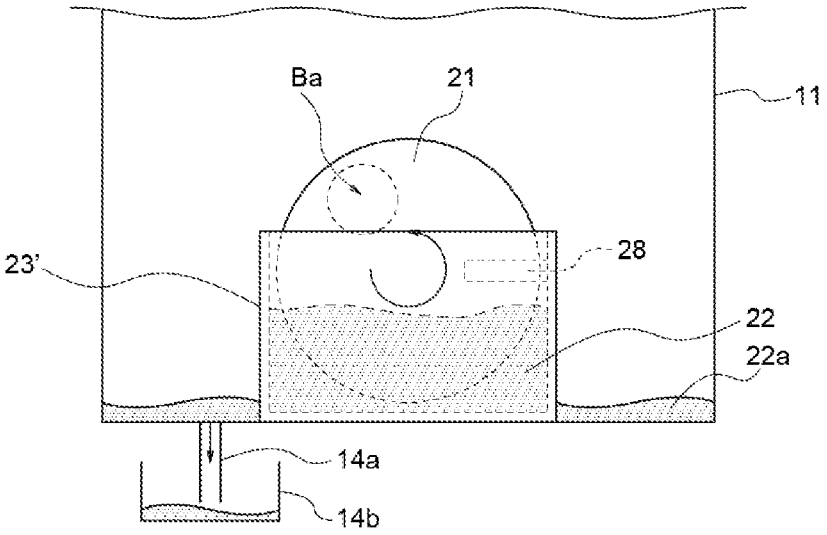
FIG. 5 shows a structure of a raw material reserving vessel in a second embodiment of the present invention.

FIG. 5 shows a structure of the raw material reserving vessel 23', which is the first raw material reserving vessel in the second embodiment.

In this embodiment, the raw material reserving vessel 23' is a container that has an opening in an upper portion thereof. The rotating body 21 is arranged such that part of the rotating body 21 is immersed in the raw material 22 stored in the raw material reserving vessel 23'. The drive mechanism, which includes the motor, to actuate the rotating body 21 is similar to that shown in FIG. 1, and the connecting structure, which includes the mechanical seal, to connect to the chamber 11 is similar to that shown in FIG. 1. Thus, the description thereof is omitted in this embodiment.

As shown in FIG. 5, the area that includes an energy beam irradiation portion Ba of the rotating body 21 is exposed to the atmosphere in the chamber 11. Thus, part of the raw material 22 adhering on the rotating body 21 is likely to leave (fly from) the rotating body 21 due to the centrifugal force generated upon the rotation of the rotating body 21, and adhere onto the inner wall of the chamber 11. If the raw material 22 is the metal that is liquid at room temperature, the raw material 22 that adheres onto the inner wall of the chamber 11 moves to the bottom of the chamber 11 and stays at the bottom of the chamber.

In this embodiment, a drain 14*a* is provided at the bottom of the chamber 11. The drain 14*a* is a discharge exit for discharging the raw material 22*a*, which has flown from the rotating body 21 and accumulated at the bottom of the chamber 11, out of the chamber 11. The raw material 22 discharged out of the chamber 11 through the drain 14*a* is collected in a reservoir 14*b*, and taken away as a waste. It should be noted that the discharge exit for discharging the raw material 22*a*, which has accumulated at the bottom of the chamber 11, may be provided at an arbitrary location and have an arbitrary shape as long as the discharge exit can discharge the raw material 22*a* to the outside. For example, the discharge exit may be a hole provided in the lower area of the side wall of the chamber 11.

As described above, the raw material reserving vessel for storing the raw material 22 does not necessarily have the jacket-like structure as in the first embodiment, i.e., the raw material reserving vessel may have a simpler structure. Also, if the raw material 22 is the metal that is liquid at room temperature and is not corrosive, the raw material 22 that flies from the rotating body 21 and adheres on the inner wall of the chamber 11 does not exert any adverse influence, and therefore it is not necessary to carry out a treatment to impart the corrosion-resistance on the inner wall of the chamber 11.

When the open-top container is used as the first raw material reserving vessel (second embodiment), an amount of raw material 22 that flies into the chamber 11 from the first raw material reserving vessel becomes large as compared to when the jacket-like structure is used as the first raw material reserving vessel. Thus, the catching mechanisms for catching the raw material 22, i.e., the rotary windows 32 and 42, are more effective and useful.

Figure 6:
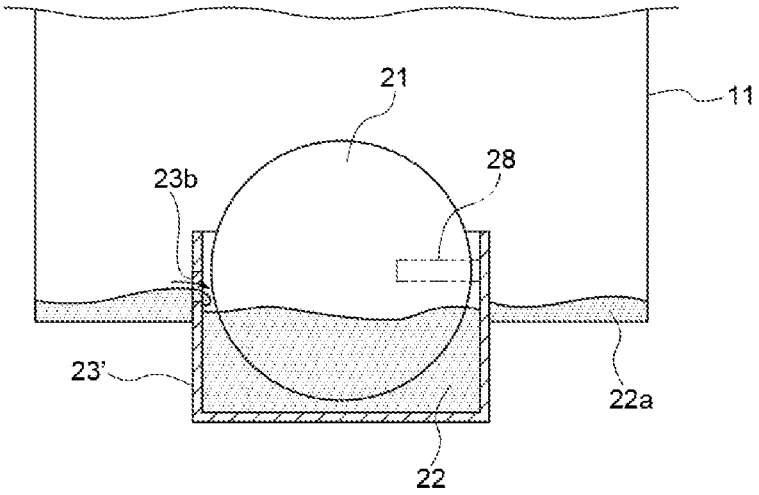
FIG. 6 shows a structure of another raw material reserving vessel.

It should be noted that although the raw material 22*a*, which has accumulated at the bottom of the chamber 11, is discharged out of the chamber 11 and taken away as a waste in this embodiment, the raw material 22*a* may return to the raw material reserving vessel 23'. For example, as shown in FIG. 6, a raw material recovering part 23*b* for recovering the raw material may be provided in the side wall of the raw material reserving vessel 23' at a position higher than the bottom of the chamber 11. This makes it possible to cause the raw material 22*a*, which has accumulated at the bottom of the chamber 11, to move into the raw material reserving vessel 23' through the raw material recovering part 23*b*. In this configuration, the drain 14*a* and the reservoir 14*b* shown in FIG. 5 are not necessary.

In FIG. 6, the lower portion of the raw material reserving vessel 23' protrudes downward from the bottom of the chamber 11. It should be noted that the raw material reserving vessel 23' does not necessarily have such structure. For example, the bottom of the raw material reserving vessel 23' coincides with the bottom of the chamber 11, as shown in FIG. 5, depending upon the diameter of the rotating body 21 and an amount of raw material 22 that is stored in the raw material reserving vessel 23'.

Modifications

Although each of the above-described embodiments includes the catching mechanism (rotary windows 32 and 42) for catching the raw material 22 in the first space, the catching mechanism may not necessarily be provided.

In each of the above-described embodiments, a plurality of energy beam inlet windows 31 may be provided and/or a plurality of X-ray outlet windows 41 may be provided. In this configuration, a plurality of openings 23*a* may be provided in the raw material reserving vessel 23 of FIG. 1 such that the openings 23*a* correspond to a plurality of energy beam inlet windows, respectively.

Although the target raw material for the X-ray generation is the metal that is liquid at room temperature in each of the above-described embodiments, the target raw material is not necessarily liquid at room temperature as long as the target raw material is liquid. However, it is preferred that the target raw material is the metal that is liquid at room temperature because it allows use of a simple structure for the X-ray generating device.

While certain embodiments have been described, these embodiments have been presented by way of example only, and are not intended to limit the scope of the present invention. The devices and methods described herein may be embodied in a variety of other forms. Furthermore, various omissions, substitutions, modifications and changes may be made to the devices and methods described herein, without departing from the gist of the present invention. The accompanying claims and their equivalents are intended to cover such forms or modifications as would fall within the scope and gist of the present invention.

REFERENCE NUMERALS AND SYMBOLS

11: Chamber
21: Rotating body
22: Target raw material for X-ray generation
23: Raw material reserving vessel
23*a*: Opening
27: Raw material circulating device
31: Energy beam inlet window
32: Rotary window
41: X-ray outlet window
42: Rotary window

The invention claimed is:

1. An X-ray generating device comprising:
a chamber;
a disc-like rotating body arranged in the chamber;
a first raw material reserving vessel configured to reserve a target raw material for X-ray generation, the target raw material being liquid;
a raw material supply mechanism configured to cause the rotating body to rotate while part of the rotating body is being immersed in the target raw material, which is reserved in the first raw material reserving vessel, thereby applying the target raw material onto at least part of a surface of the rotating body;
an energy beam inlet window disposed at an opening of the chamber and configured to transmit an energy beam, which is directed to the target raw material on the surface of the rotating body, and allow the energy beam to enter an interior of the chamber from an exterior of the chamber; and
an X-ray outlet window disposed at the opening of the chamber and configured to transmit an X ray, which is generated upon irradiating the target raw material with the energy beam, and allow the X ray to proceed out of the chamber.

2. The X-ray generating device according to claim 1, wherein the target raw material is liquid at room temperature.

3. The X-ray generating device according to claim 2 further comprising a first catching member disposed between the rotating body and the X-ray outlet window and configured to transmit the X ray and catch the target raw material.

4. The X-ray generating device according to claim 3 further comprising a second catching member disposed between the rotating body and the energy beam inlet window and configured to transmit the energy beam and catch the target raw material.

5. The X-ray generating device according to claim 4 further comprising a film thickness adjusting unit configured to adjust a film thickness of the target raw material on the surface of the rotating body to a predetermined film thickness,
wherein the film thickness adjusting unit has a film thickness adjusting member that faces the surface of the rotating body with a predetermined gap, and the predetermined gap corresponds to the predetermined film thickness.

6. The X-ray generating device according to claim 5, wherein the first raw material reserving vessel is a jacket-like structure that encloses the rotating body, and
the first raw material reserving vessel has an opening at a position corresponding to the area of the rotating body which is irradiated with the energy beam such that the energy beam passes through the opening.

7. The X-ray generating device according to claim 1 further comprising a first catching member disposed between the rotating body and the X-ray outlet window and configured to transmit the X ray and catch the target raw material.

8. The X-ray generating device according to claim 7, wherein the first catching member is a plate-like rotating member.

9. The X-ray generating device according to claim 1 further comprising a second catching member disposed between the rotating body and the energy beam inlet window and configured to transmit the energy beam and catch the target raw material.

10. The X-ray generating device according to claim 9, wherein the second catching member is a plate-like rotating member.

11. The X-ray generating device according to claim 1 further comprising a film thickness adjusting unit configured to adjust a film thickness of the target raw material on the surface of the rotating body to a predetermined film thickness, wherein the film thickness adjusting unit has a film thickness adjusting member that faces the surface of the rotating body with a predetermined gap, and the predetermined gap corresponds to the predetermined film thickness.

12. The X-ray generating device according to claim 11, wherein the film thickness adjusting member is located at a position that can adjust the film thickness of the target raw material in an area of the rotating body which is irradiated with the energy beam.

13. The X-ray generating device according to claim 1, wherein the first raw material reserving vessel is a jacket-like structure that encloses the rotating body, and the first raw material reserving vessel has an opening at a position corresponding to the area of the rotating body which is irradiated with the energy beam such that the energy beam passes through the opening.

14. The X-ray generating device according to claim 1, wherein the first raw material reserving vessel is a container that has an opening in its upper portion.

15. The X-ray generating device according to claim 14 further comprising a discharge exit formed at a lower portion of the chamber and configured to discharge the target raw material, which has accumulated at a bottom of the chamber, out of the chamber.

16. The X-ray generating device according to claim 14, wherein the first raw material reserving vessel has a raw material recovering hole formed in a side wall of the first raw material reserving vessel at a position above the bottom of the chamber and configured to cause the target raw material, which has accumulated at the bottom of the chamber, to move into the first raw material reserving vessel.

17. The X-ray generating device according to claim 1, wherein the chamber has a first space, which includes a space for arranging the energy beam inlet window and the X-ray outlet window, and a second space, which includes a space for arranging the rotating body, and the second space is spatially connected to the first space, and an atmosphere in the second space is set to a lower pressure than an atmosphere in the first space.

18. The X-ray generating device according to claim 1 further comprising a cooling mechanism configured to cool the target raw material in the first raw material reserving vessel.

19. The X-ray generating device according to claim 1 further comprising:

a second raw material reserving vessel disposed outside the chamber and configured to reserve the target raw material; and a circulating mechanism configured to circulate the target raw material between the first raw material reserving vessel and the second raw material reserving vessel.

20. The X-ray generating device according to claim 1, wherein the target raw material is gallium or a gallium alloy.

* * * * *